US011529976B2

(12) United States Patent
Hoffmann et al.

(10) Patent No.: US 11,529,976 B2
(45) Date of Patent: Dec. 20, 2022

(54) CHASSIS FOR RAIL VEHICLES

(71) Applicant: SIEMENS MOBILITY GmbH, Vienna (AT)

(72) Inventors: Thilo Hoffmann, Graz (AT); Martin Teichmann, Graz (AT); Gerhard Weilguni, Graz (AT)

(73) Assignee: SIEMENS MOBILITY AUSTRIA GMBH, Vienna (AT)

( * ) Notice: Subject to any disclaimer, the term of this patent is extended or adjusted under 35 U.S.C. 154(b) by 646 days.

(21) Appl. No.: 16/487,327

(22) PCT Filed: Feb. 21, 2017

(86) PCT No.: PCT/EP2017/053925
§ 371 (c)(1),
(2) Date: Aug. 20, 2019

(87) PCT Pub. No.: WO2018/153436
PCT Pub. Date: Aug. 30, 2018

(65) Prior Publication Data

US 2020/0062282 A1 Feb. 27, 2020

(51) Int. Cl.
*B61F 5/32* (2006.01)
*B61F 5/30* (2006.01)
(Continued)

(52) U.S. Cl.
CPC ..... *B61F 5/30* (2013.01); *B61F 5/301* (2013.01); *B61F 5/32* (2013.01); *B61F 5/325* (2013.01); *B61F 5/386* (2013.01); *B61F 5/52* (2013.01)

(58) Field of Classification Search
CPC ..... B61F 5/00; B61F 5/26; B61F 5/28; B61F 5/30; B61F 5/301; B61F 5/302;
(Continued)

(56) References Cited

U.S. PATENT DOCUMENTS 4,742,779 A 5/1988 Bevand
9,592,840 B2 * 3/2017 Okumura ..... B61F 5/32
(Continued)

FOREIGN PATENT DOCUMENTS

DE 102014214055 1/2016
EP 0759390 2/1997
(Continued)

OTHER PUBLICATIONS

PCT International Search Report dated Nov. 21, 2017 based on PCT/EP2017/053925 filed Feb. 21, 2017.

*Primary Examiner* — Zachary L Kuhfuss
*Assistant Examiner* — Cheng Lin
(74) *Attorney, Agent, or Firm* — Cozen O'Connor

(57) ABSTRACT

A chassis for rail vehicles includes at least one first wheel and one second wheel, at least one first wheel bearing having a first wheel bearing housing and a second wheel bearing having a second wheel bearing housing, at least one first primary spring and one second primary spring, at least one primary spring-loaded support structure and at least one active wheel positioning device, which has an actuator unit, where a first bearing and a second bearing are provided between the at least one wheel positioning device and the at least one support structure, and a guide is provided between the at least one wheel positioning device and the first wheel bearing housing, and where the unsuspended mass of the chassis is reduced by the suspension of the wheel positioning device on the primary spring-loaded support structure in order to create advantageous design conditions.

12 Claims, 1 Drawing Sheet

(51) Int. Cl.
*B61F 5/52* (2006.01)
*B61F 5/38* (2006.01)

(58) Field of Classification Search
CPC ..... B61F 5/304; B61F 5/305; B61F 5/307; B61F 5/308; B61F 5/32; B61F 5/325; B61F 5/36; B61F 5/38; B61F 5/386; B61F 5/46; B61F 5/50; B61F 5/52
See application file for complete search history.

(56) References Cited

U.S. PATENT DOCUMENTS

| | | | | |
|---|---|---|---|---|
| 10,300,932 | B2 * | 5/2019 | Meyer | B61F 5/325 |
| 10,625,756 | B2 * | 4/2020 | Rackl | B61F 5/325 |
| 2011/0253004 | A1 * | 10/2011 | Nishimura | F16F 1/38 105/220 |

FOREIGN PATENT DOCUMENTS

| | | | | |
|---|---|---|---|---|
| EP | 0870664 | | 10/1998 | |
| EP | 1569835 | | 9/2005 | |
| GB | 2396143 | | 6/2004 | |
| JP | 2013126835 | | 6/2013 | |
| JP | 2013126835 | A * | 6/2013 | B61F 5/386 |
| WO | WO2009072692 | | 6/2009 | |
| WO | WO-2009072692 | A1 * | 6/2009 | B61F 5/386 |

* cited by examiner

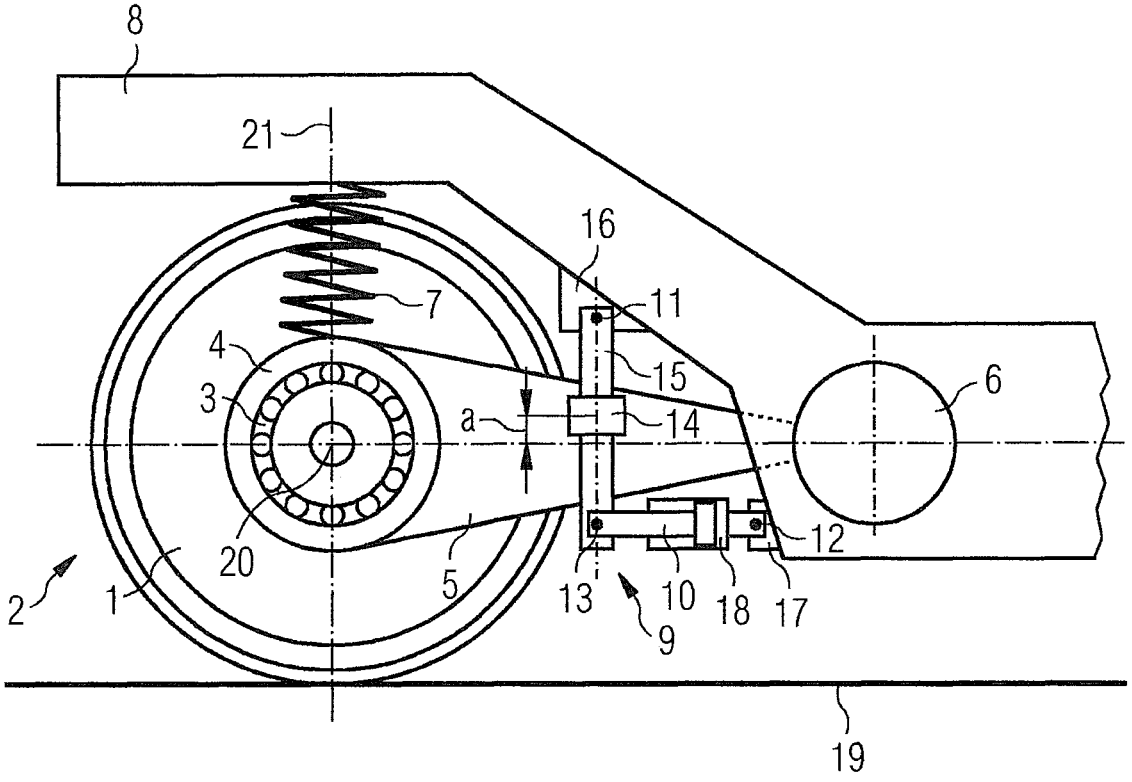
8
21
16
11
7
4
15
6
3
a
14
20
12
2
1
5
13
10
18
17
9
19

CHASSIS FOR RAIL VEHICLES

CROSS-REFERENCE TO RELATED APPLICATIONS

This is a U.S. national stage of application No. PCT/EP2017/053925 filed Feb. 21, 2017, the content of which is incorporated herein by reference in its entirety.

BACKGROUND OF THE INVENTION

1. Field of the Invention

The invention relates to a chassis for rail vehicles, which comprises at least one first wheel and one second wheel, at least one first wheel bearing with a first wheel bearing housing and one second wheel bearing with a second wheel bearing housing, at least one first primary spring and one second primary spring, at least one primary spring-mounted support structure as well as at least one active wheel actuating facility, which has an actuator unit.

2. Description of the Related Art

Chassis for rail vehicles need to have a high degree of safety while traveling. This can be improved, for instance, by the arrangement of an active wheel controller or wheelset controller. The targeted actuation of wheels or wheelsets by actively rotating them about their vertical axes serves to prevent unstable travel statuses in a known manner. Furthermore, this increases the travel comfort by avoiding disruptive vibrations in a rail vehicle. In addition, the active wheel controller or wheelset controller brings about a reduction in the wear on wheels and rails.

Installing an active wheel controller or wheelset controller necessitates having to arrange additional components (e.g., actuators) in the chassis. Depending on the mounting of the components on the chassis, this may lead to high unsprung masses and to a heavy loading of track bodies and on the components of the wheel controller or wheelset controller itself.

High unsprung masses of a vehicle, and a heavy loading of a track body may, for instance, lead to high route usage fees (e.g., Track Access Charges in the United Kingdom), which must be paid by a vehicle operator.

EP 1 569 835 B1, for instance, describes a wheelset guiding structure with vertical, lateral and longitudinal guide elements, which guide a wheelset of a chassis in three spatial directions. The longitudinal guide element is formed as a guide bar and connects a chassis frame to a wheelset bearing, i.e., is mounted on the chassis frame and the wheelset bearing.

EP 0 759 390 B1 discloses a chassis for a rail vehicle with a wheelset actuating facility. The disclosed wheelset actuating facility has a coupling facility as well as an adjustment apparatus, via which steering angles of wheelsets are set according to a track curve to be passed through. The coupling facility comprises two coupling shafts that are mounted on a chassis frame and to which four longitudinal steering rods are connected. Each longitudinal steering rod is mounted on a wheelset bearing.

The approaches mentioned, in their known forms, have the disadvantage that components of the wheelset guiding or wheelset actuating facilities are partially mounted on wheelset bearings and unsprung masses of the chassis increase as a result.

SUMMARY OF THE INVENTION

It is therefore an object of the invention to provide a chassis which has been further developed compared with the prior art.

This and other object and advantages are achieved in accordance with the invention by a chassis for rail vehicles in which a first bearing and a second bearing are provided between the at least one wheel actuating facility and the at least one support structure, and a guide is provided between the at least one wheel actuating facility and the first wheel bearing housing.

The wheel actuating facility is connected to the support structure via the first bearing and the second bearing, which are arranged on the primary spring-mounted support structure or on adapters connected to the support structure. It is possible to dispense with mounting the wheel actuating facility on the wheel bearing housing or on a rocker arm arranged between the first wheel and the support structure. As a result, the wheel actuating facility is mounted on the chassis in a primary spring-mounted manner, whereby unsprung masses of the chassis are reduced. Furthermore, the loading of a track body and the wheel actuating facility itself is reduced. Actuating forces are transferred via the guide between the wheel actuating facility and the wheel bearing housing and steering angles of the first wheel are set or the first wheel is guided on a track. An increase in travel stability and travel comfort and a reduction in wear on wheels and rails occurs as a result. Furthermore, acoustic advantages are also achieved.

It is favorable if the at least one wheel actuating facility comprises a lever, where the first bearing is arranged between the lever and the at least one support structure and a third bearing is arranged between the lever and the actuator unit.

Actuating forces acting on the first wheel are transferred from the actuator unit and via the lever to the wheel bearing housing. In this context, the lever brings about a favorable force transmission, whereby the actuator unit can be dimensioned in a compact manner.

An advantageous solution is obtained when the actuator unit has at least one pneumatic actuator. This achieves the advantage that a compressed air system provided in the rail vehicle, e.g., for a pneumatic brake system, can also be used to supply the actuator unit, leaks in the actuator unit do not lead to any environmental pollution and the actuator unit can be separated from the compressed air system in a simple manner for maintenance purposes and connected to it once again.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention is explained in further detail below with reference to exemplary embodiments, in which, by way of example:

The FIGURE shows a side view of an exemplary embodiment of a chassis according to the invention, where a detail of a primary spring-mounted support structure, a first wheel, a first wheel bearing housing, a rocker arm and a wheel actuating facility are shown.

DETAILED DESCRIPTION OF THE EXEMPLARY EMBODIMENTS

A detail, shown in a side view in the FIGURE, of an exemplary embodiment of a chassis in accordance with the invention of a rail vehicle comprises a detail of a support structure 8 as well as a first wheel 1, which lies against a track 19.

The support structure 8 is formed as a chassis frame with sole bars and a cross member. In accordance with the invention, with regard to geometry, connection technology, or materials, different embodiments of support structures 8 are conceivable.

The support structure 8 may be formed/structured as one part or as multiple parts. In multipart embodiments, it is possible, for instance, to interconnect individual parts in an articulated manner, etc.

The first wheel 1 is arranged around a crossarm 20 and connected to a first wheelset shaft (not shown) which extends along the crossarm 20. Arranged on the first wheelset shaft is a first wheel bearing 3, which is shrouded by a first wheel bearing housing 4.

The first wheel bearing housing 4 is connected to a first rocker arm 5, which is coupled to the support structure 8 via a first wheel guiding bushing 6. In accordance with the invention, it is also conceivable that the first wheel bearing housing 4 itself performs the function of the first rocker arm 5, i.e., is connected to the support structure 8 via the first wheel guiding bushing 6, whereby it is possible to dispense with the first rocker arm 5.

A second wheel (not visible in the FIGURE) is connected to the first wheelset shaft. Together with the first wheelset shaft and the second wheel, the first wheel 1 forms a first wheelset 2. The first wheelset 2 is connected to the support structure 8 via a second wheel bearing, a second wheel bearing housing, a second rocker arm as well as via a second wheel guiding bushing.

Furthermore, the chassis comprises a second wheelset (not shown), which comprises a third wheel, a fourth wheel as well as a second wheelset shaft. The second wheelset is connected to the support structure 8 via a third wheel bearing and a fourth wheel bearing, via a third wheel bearing housing and a fourth wheel bearing housing, via a third rocker arm and a fourth rocker arm as well as via a third wheel guiding bushing and a fourth wheel guiding bushing. The support structure 8 is mounted on the first wheelset 2 and the second wheelset in a primary spring-mounted manner.

Arranged between the first wheel bearing housing 4 and the support structure 8 is a first primary spring 7, between the second wheel bearing housing and the support structure 8 a second primary spring, between the third wheel bearing housing and the support structure 8 a third primary spring and between the fourth wheel bearing housing and the support structure 8 a fourth primary spring.

In accordance with the invention, it is also conceivable that the chassis, instead of a first wheelset 2 and a second wheelset, has idler pairs which are frequently used in low-floor streetcar vehicles.

The chassis shown in the FIGURE features an exterior mounting. In accordance with the invention, it is also conceivable, however, to form the chassis with interior mounting.

Connected to the support structure 8 via two bearing points and thus suspended in a primary spring-mounted manner is a wheel actuating facility 9, which comprises an actuator unit 10 as well as a lever 15. As a result of this primary spring-mounted suspension, unsprung masses of the chassis are reduced. The actuator unit 10 has a pneumatic actuator 18, which is known from the prior art and is connected to a compressed air system of the rail vehicle via compressed air connections and compressed air lines (not shown).

The pneumatic actuator 18 comprises a cylinder as well as a piston. Pressures acting in the cylinder bring about forces on the piston, which are transferred via the lever 15 and act on the first wheelset 2 as actuating forces. The pneumatic actuator 18 is connected to a regulation unit (not shown) of the rail vehicle for pressure regulation, and thus actuating force regulation. In accordance with the invention, the actuator unit 10 may also have a hydraulic actuator.

The lever 15 is connected to a first adapter 16 via a resilient first bearing 11, the actuator unit 10 to a second adapter 17 via a resilient second bearing 12. The first adapter 16 and the second adapter 17 are welded to the support structure 8. In accordance with the invention, it is also conceivable for instance, however, that the first adapter 16 and the second adapter 17 are screwed to the support structure 8.

In accordance with the invention, it is also conceivable to arrange the first bearing 11 and the second bearing 12 immediately on the support structure 8, i.e., to dispense with the first adapter 16 and the second adapter 17.

The lever 15 is connected to the actuator unit 10 via a third bearing 13 configured as a rotary joint and guided through a sliding joint 14 configured as a resilient bushing and arranged on the first rocker arm 5. The position of the sliding joint 14 on the first rocker arm 5 is defined via the spacing a. In accordance with the invention, it is also conceivable to arrange the sliding joint 14 on the first wheel bearing housing 4.

Forces generated by the pneumatic actuator 18 are transferred via the lever 15 acting as a force transmitter and the sliding joint 14 to the first rocker arm 5 and thus to the first wheel bearing housing 4, the first wheel bearing 3 as well as to the first wheelset 2. The first wheelset 2 can be rotated about a vertical axis 21 as a result. This means that actuating angles of the first wheelset 2 are set, i.e., the orientation of the first wheelset 2 is adapted to a geometry of the track 19. The spacing a can be chosen according to a force transmission required. The pneumatic actuator 18 can be compact in design due to the lever 15 or the force transmission.

In accordance with the invention, it is also conceivable that more than one wheel actuating facility 9 is connected to the support structure 8. For instance, two wheel actuating facilities 9 may be arranged to apply the actuating forces to the first wheelset 2 and the second wheelset. Furthermore, it is also possible to arrange wheel actuating facilities 9 at both ends of the first wheelset 2 and the second wheelset in each case, i.e. four wheel actuating facilities 9 overall.

The actuating forces to be generated are set and coordinated in the regulation unit with regard to their magnitudes and directions.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A chassis for rail vehicles, the chassis comprising:

at least one first wheel and one second wheel;

at least one first wheel bearing with a first wheel bearing housing and one second wheel bearing with a second wheel bearing housing;

at least one first primary spring and one second primary spring;

at least one primary spring-mounted support structure; and at least one active wheel actuating facility, which has an actuator unit;

a first bearing and a second bearing are arranged between the at least one wheel actuating facility and the at least one support structure, and a guide is provided between the at least one wheel actuating facility and the first wheel bearing housing;

wherein the at least one wheel actuating facility comprises a lever;

wherein the first bearing is arranged between the lever and at least one primary spring-mounted support structure and a third bearing is arranged between the lever and the actuator unit; and wherein the lever is guided through a sliding joint arranged on the first wheel bearing housing or guided through a sliding joint arranged on a first rocker arm connected to the at least one support structure.

2. The chassis as claimed in claim 1, wherein the sliding joint comprises a resilient bushing.

3. The chassis as claimed in claim 1, wherein the first bearing is arranged on a first adapter connected to the at least one support structure.

4. The chassis as claimed in claim 1, wherein the second bearing is arranged on a second adapter connected to the at least one support structure.

5. The chassis as claimed in claim 1, wherein the actuator unit includes at least one pneumatic actuator.

6. The chassis as claimed in claim 1, wherein the actuator unit includes at least one hydraulic actuator.

7. The chassis as claimed in claim 1, wherein the at least one support structure comprises a chassis frame.

8. The chassis as claimed in claim 1, wherein the first bearing and the second bearing are resilient.

9. The chassis as claimed in claim 1, wherein the first bearing and the second bearing comprise rotary joints.

10. The chassis as claimed in claim 1, wherein the third bearing comprises a rotary joint.

11. The chassis as claimed in claim 1, wherein the at least first wheel and the second wheel are interconnected such that a first wheelset is formed.

12. The chassis as claimed in claim 1, wherein the at least first wheel and the second wheel are configured to form an idler pair.

* * * * *